US009636535B2

(12) United States Patent
Schleiden, II

(10) Patent No.: US 9,636,535 B2
(45) Date of Patent: May 2, 2017

(54) DOOR-MOUNTED PORTABLE EXERCISE APPARATUS

(71) Applicant: Roy Randolph Schleiden, II, Lees Summit, MO (US)

(72) Inventor: Roy Randolph Schleiden, II, Lees Summit, MO (US)

( * ) Notice: Subject to any disclaimer, the term of this patent is extended or adjusted under 35 U.S.C. 154(b) by 159 days.

(21) Appl. No.: 13/953,357

(22) Filed: Jul. 29, 2013

(65) Prior Publication Data

US 2015/0031512 A1 Jan. 29, 2015

(51) Int. Cl.

| | |
|---|---|
| ***A63B 21/16*** | (2006.01) |
| ***A63B 21/04*** | (2006.01) |
| ***A63B 21/055*** | (2006.01) |
| ***A63B 23/035*** | (2006.01) |
| ***A63B 23/12*** | (2006.01) |
| *A63B 7/00* | (2006.01) |
| *A63B 21/068* | (2006.01) |

(52) U.S. Cl.

CPC ..... *A63B 21/0442* (2013.01); *A63B 21/0552* (2013.01); *A63B 21/1645* (2013.01); *A63B 23/03541* (2013.01); *A63B 23/1209* (2013.01); *A63B 7/00* (2013.01); *A63B 21/068* (2013.01)

(58) Field of Classification Search

CPC ..... A63B 21/1618–21/1663

USPC ..... 482/40, 129, 121, 126

See application file for complete search history.

(56) References Cited

U.S. PATENT DOCUMENTS

| | | | | |
|---|---|---|---|---|
| 6,322,483 | B1 | 11/2001 | Rotella | |
| 6,908,418 | B2 * | 6/2005 | Saure | A63B 21/0552 482/121 |
| 8,197,392 | B2 | 6/2012 | Silverman et al. | |
| 2006/0040811 | A1 * | 2/2006 | Foster | A63B 21/1473 482/142 |

* cited by examiner

*Primary Examiner* — Loan H Thanh
*Assistant Examiner* — Rae Fischer
(74) *Attorney, Agent, or Firm* — Mashburn Law Office, LLC; Donna Denise Masburn Chapman

(57) ABSTRACT

A door-mounted portable exercise apparatus having a non-elastic adjustable strap that extends vertically around a door. An attached connector maintains the adjustable strap in a snug position around the door. A first anchor and a second anchor are secured to the adjustable strap by a re-enforcing strap near the top edge of the door. When the door is closed, the first anchor is positioned near the junction of the closing face of the door and the door frame, and the second anchor is positioned near the junction of the opening face of the door and the door frame. At least two non-elastic loops are attached near the top and bottom of the adjustable strap by short strips on the closing side of the door. Elastic bands of various tensions can be attached to or passed through at least one non-elastic loop of the apparatus to permit a wide range of exercise motions by a user.

5 Claims, 8 Drawing Sheets

DOOR-MOUNTED PORTABLE EXERCISE APPARATUS

FIELD OF INVENTION

The present invention relates generally to a portable exercise apparatus having a non-elastic adjustable strap that mounts vertically around a door. A connector maintains the adjustable strap in a snug position around the door. In particular, the invention relates to an exercise apparatus having first and second anchors that are attached to the adjustable strap by a re-enforcing strap. The two anchors are positioned on either side of the top edge of a closed door to secure the exercise apparatus and to prevent the adjustable strap from slipping in either direction during use without damaging the door. At least two non-elastic loops are attached to the adjustable strap by short strips near the top and bottom of the closing face of the door. Elastic bands of various tensions can be attached to or passed through at least one non-elastic loop of the apparatus to permit a wide range of exercise motions by a user. Other aspects and advantages of the present invention will be apparent from the following detailed description of the embodiments and the accompanying drawings.

BRIEF DESCRIPTION OF THE DRAWINGS

The accompanying drawings illustrate embodiments of the invention and are for illustration by way of example and not limitations.

DETAILED DESCRIPTION OF EMBODIMENTS

Figure 1:
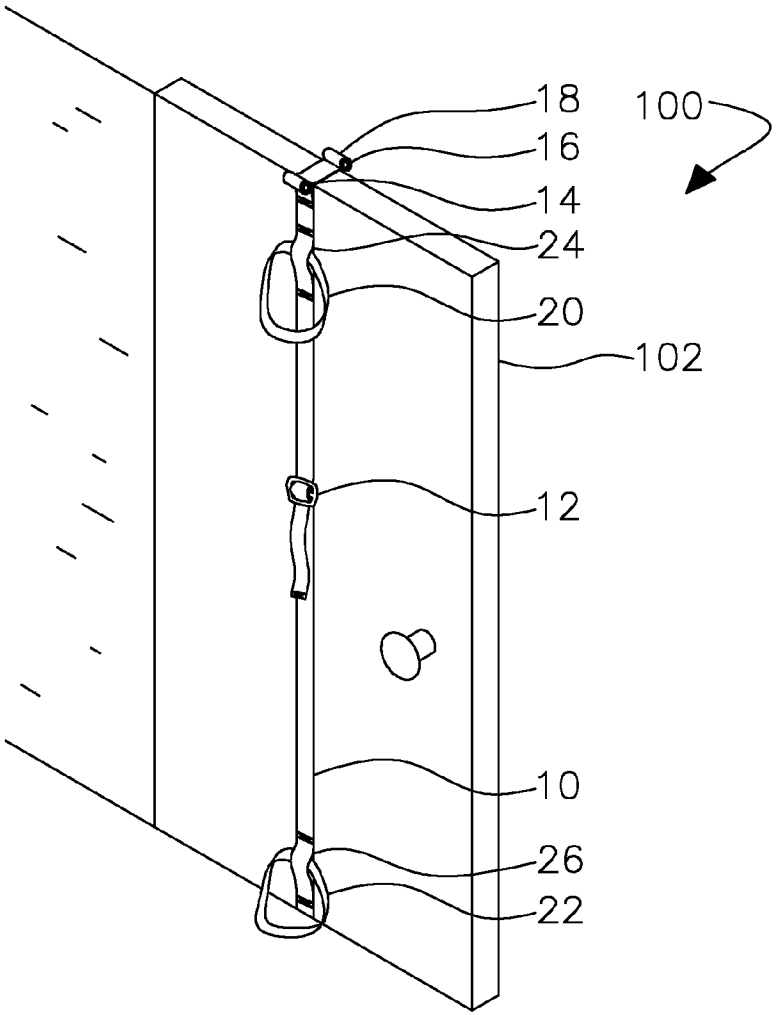
FIG. 1 illustrates a top perspective view of the closing face of a door with the exercise apparatus mounted to the closed door as it faces the user, in accordance with an embodiment of the invention.
Figure 2:
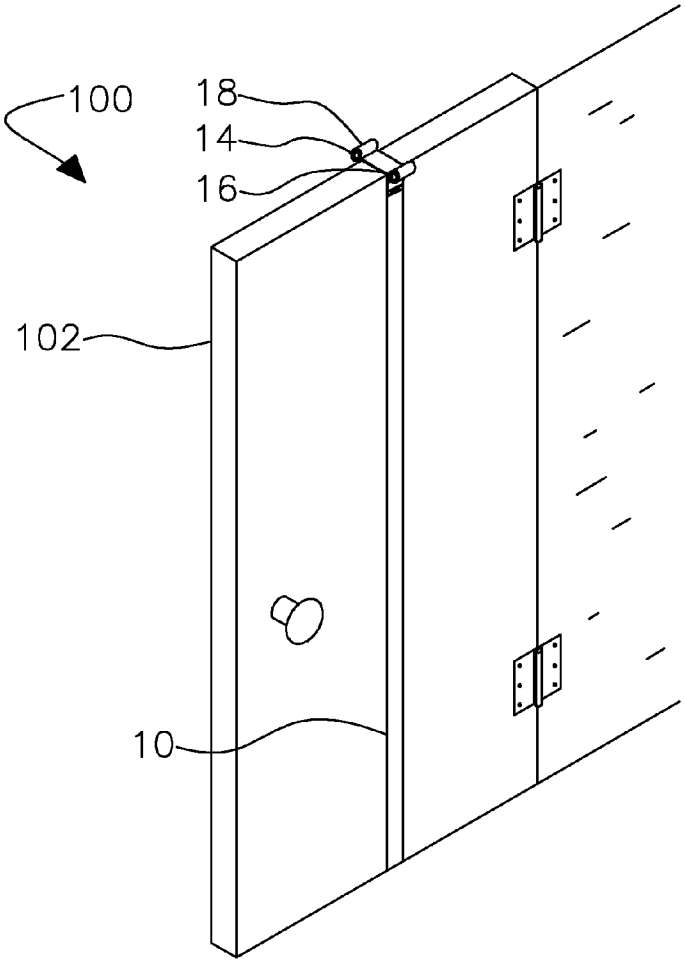
FIG. 2 illustrates a top perspective view of the opening face of a door with the back of the exercise apparatus mounted to the door, in accordance with an embodiment of the invention.

The present invention is to a door-mounted portable exercise apparatus 100 as shown in FIGS. 1-8. Specifically, the invention is a non-elastic adjustable strap 10 that mounts vertically to a door 102 by a connector 12 as shown in FIG. 1. The exercise apparatus 100 is held firmly in place during use by two anchors, 14, 16 that are positioned on either side of the top edge of the door 102, as shown in FIGS. 1-2. A user 104 may exercise using the apparatus 100 and a variety of exercise attachments, such as elastic bands 106, as shown in FIGS. 3-6.

The adjustable strap 10 is formed from a flexible elongate strip of webbing, nylon, woven fabric, or any other strong textile material that can be looped around and secured to doors of various heights and widths in residential and commercial buildings. The adjustable strap 10 extends around a door 102 in a vertical direction. The connector 12 enables the adjustable strap 10 to be vertically mounted and tightened snuggly around the door 102. The connector 12 can be attached to the adjustable strap 10 on either side of the door 102. In one embodiment, as shown in FIG. 1, the connector 12 is attached to the adjustable strap 10 on the closing face of the door 102. The connector 12 can be a buckle, as shown in FIG. 1, a plastic tension lock, a side release plastic clip, a side release buckle, Velcro®, or any other locking mechanism.

Two anchors 14, 16 are attached to the adjustable strap 10 where it crosses the top edge of the door 102. The anchors 14, 16 are secured inside a re-enforcing strap 18. The re-enforcing strap 18 surrounds each of the anchors 14, 16 and is attached to the adjustable strap 10 by sewing, glue, epoxy, snaps, or other adhesives or types of fasteners. The anchors 14, 16 are too large to pass through the narrow space located between the top edge of the door 102 and respective door frame 108 when the door 102 is in a closed position, as best shown in FIG. 7.

Figure 7:
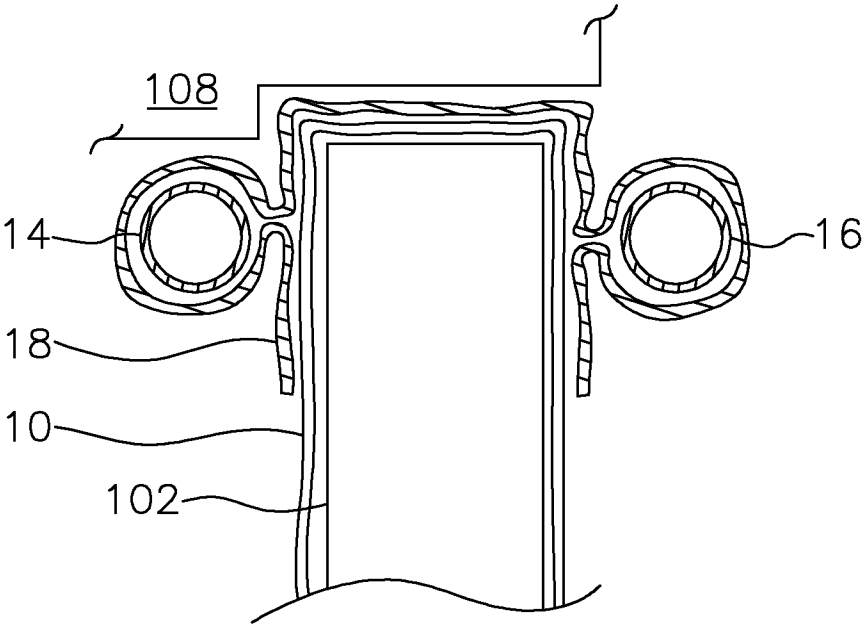
FIG. 7 illustrates a side elevation view of the top portion of the apparatus when the door is in a closed position. The first anchor is positioned near the junction of the closing face of the door and the door frame, and the second anchor is positioned near the junction of the opening face of the door and the door frame.

In FIG. 7, the upper portion of the exercise apparatus 100 has been enlarged to clearly illustrate how the adjustable strap 10 is mounted over the top of the door 102. The door 102 is in a closed position with the first anchor 14 positioned near the junction of the closing face of the door 102 and the door frame 108. The second anchor 16 is positioned near the junction of the opening face of the door 102 and the door frame 108. In this embodiment, both of the anchors 14, 16 are tubular. In another embodiment, one or both of the anchors 14, 16 can be solid. The anchors 14, 16 can be made of plastic, metal, rubber, or any other strong unbreakable material that resists compression. The re-enforcing strap 18 tightly wraps around and secures each of the anchors 14, 16 in position on opposite sides of the door 102. The anchors 14, 16 are held inside re-enforcing strap 18 by friction, glue, epoxy, or any other types of adhesives.

Turning again to FIG. 1, non-elastic loops 20, 22 are attached to the adjustable strap 10 near the top and bottom of the door 102. The non-elastic loops 20, 22 can be made of webbing, nylon, woven fabric, plastic, or metal, e.g., a carbineer, or any other strong non-elastic material. The first non-elastic loop 20 is inserted through a first short strip 24. The first short strip 24 is attached to the adjustable strap 10 near the bottom of the door 102. The second non-elastic loop 22 is inserted through a second short strip 26. The second short strip 26 is attached to the adjustable strap 10 near the top of the closed door 102. The two short strips 24, 26 can be made of webbing, nylon, woven fabric, or any other strong textile material. The ends of the short strips 24, 26 are securely attached to the adjustable strap 10 by sewing, glue, epoxy, snaps or other adhesives or types of fasteners.

As shown in FIG. 2, the adjustable strap 10 of the exercise apparatus 100 continues vertically around the opening face of the door 102. The first anchor 14 is positioned on the closing face of the door 102, and the second anchor 16 is positioned on the opening face of the door 102. The reinforcing strap 18 surrounds and secures the anchors 14, 16 to the adjustable strap 10.

Figure 3:
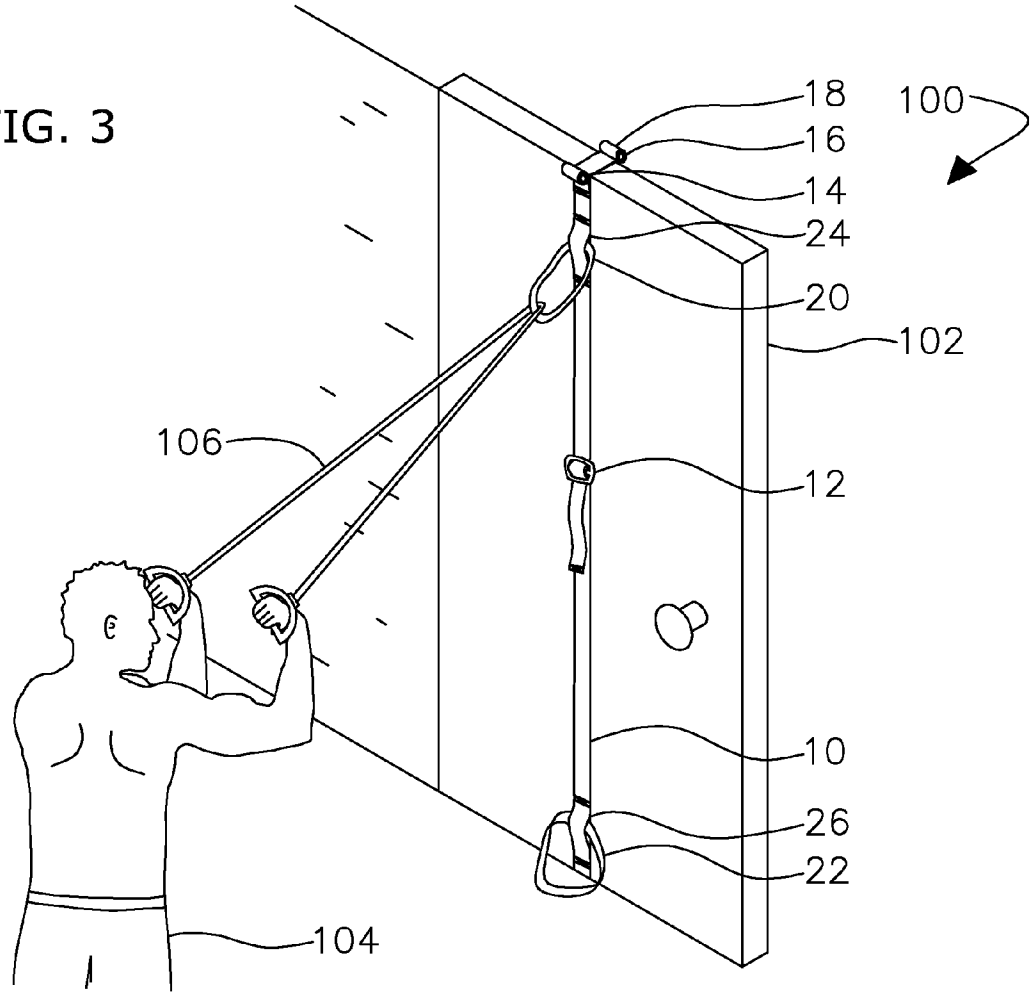
FIG. 3 illustrates a top perspective view of an exercising user using the first non-elastic loop of the apparatus, in accordance with an embodiment of the invention.

In one embodiment of the invention, as shown in FIG. 3, a user 104 is using the exercise apparatus 100 to exercise various arm and back muscles. The user 104 wraps the adjustable strap 10 vertically around the door 102, positions the first and second anchors 14, 16 across the top of the door 102 as shown in FIGS. 1-7, connects the ends of the adjustable strap 10 with the connector 12, and tightens the adjustable strap 10.

In FIG. 3, an elastic band 106 has been inserted through the first non-elastic loop 20 of the exercise apparatus 100. Elastic bands 106 of various lengths and tensions can be utilized to exercise different muscles and/or muscle groups. The door 102 is in a closed position with the first anchor 14 positioned near the junction of the closing face of the door 102 and the door frame 108 (as best shown in FIG. 7). The second anchor 16 is positioned near the junction of the opening face of the door 102 and the door frame 108. The door frame 108 secures the closed door 102 and prevents the user 104 from pulling the door 102 open while exercising. The two anchors 14, 16 secure the adjustable strap 10 and prevent it from slipping in multiple directions including up, down, or sideways on the door 102 when the user 104 pulls on the ends of the elastic band 106 while exercising.

This multi-directional anchorage provides three important advantages. First, it ensures the user's safety by preventing any slippage of the exercise apparatus 100. Without anchors 14, 16 to secure the adjustable strap 10 in place, the exercise apparatus 100 could slip causing the user 104 to fall, hit the door, pull a muscle, tear a tendon, or otherwise be seriously injured while exercising. Moreover, having the adjustable strap 10 mounted securely around the door 102 permits a physically strong user 104 to exert a large amount of force with two or more exercise bands in order to effectively exercise. Second, the two anchors 14, 16 secure the adjustable strap 10 without damaging the door 102 or the door frame 108. A user 104 can exercise with this apparatus 100 while traveling without being concerned that the adjustable strap 10 will damage a door 102 at a hotel, work, or a friend's home, etc. Third, the user 104 can exercise in various orientations and directions without disassembling or adjusting the exercise apparatus 100, as described below.

Figure 4:
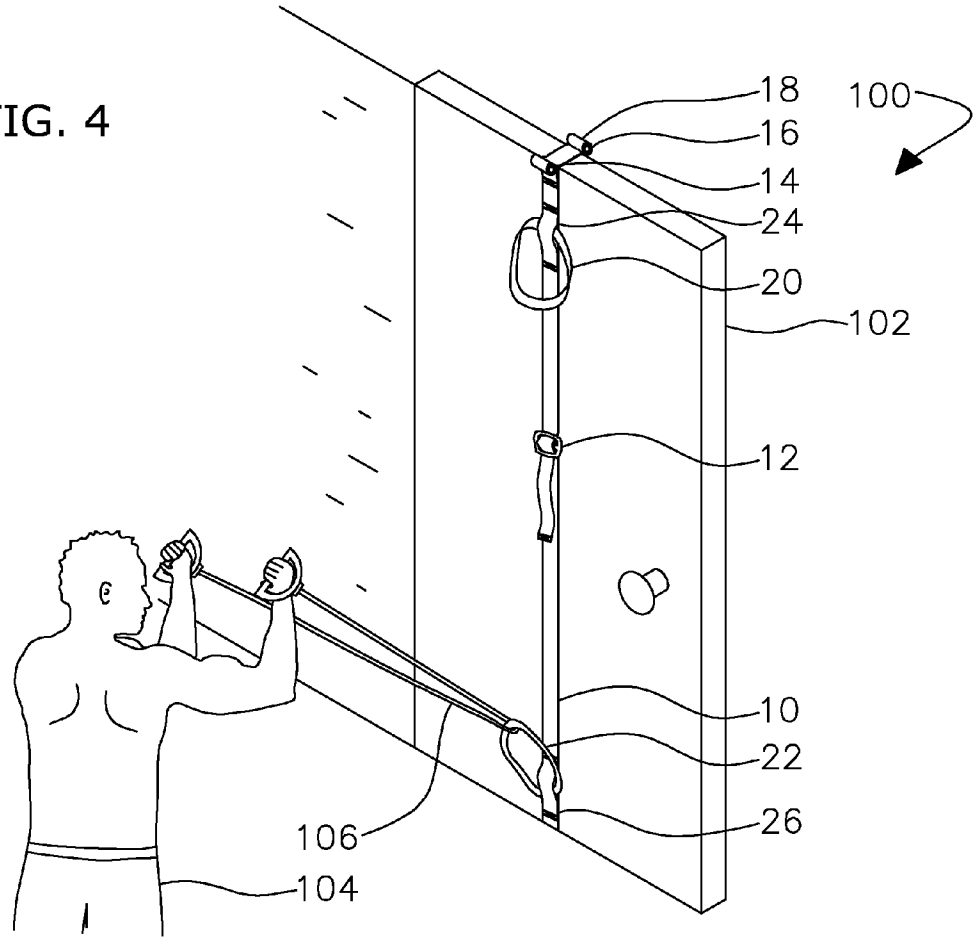
FIG. 4 illustrates a top perspective view of an exercising user using the second non-elastic loop of the apparatus, in accordance with an embodiment of the invention.

In another embodiment of the invention, as shown in FIG. 4, the user 104 is utilizing the exercise apparatus 100 to exercise wherein an elastic band 106 has been inserted through the second non-elastic loop 22 of the exercise apparatus 100. The user 104 is pulling on the ends of elastic band 106 with both arms to exercise various arm and back muscles at a different angle than previously shown in FIG. 3. The door 102 is in a closed position with the first anchor 14 positioned near the junction of the closing face of the door 102 and the door frame 108. The second anchor 16 is positioned near the junction of the opening face of the door 102 and the door frame 108. The door frame 108 secures the closed door 102 and prevents the user 104 from pulling the door 102 open while exercising.

Figure 5:
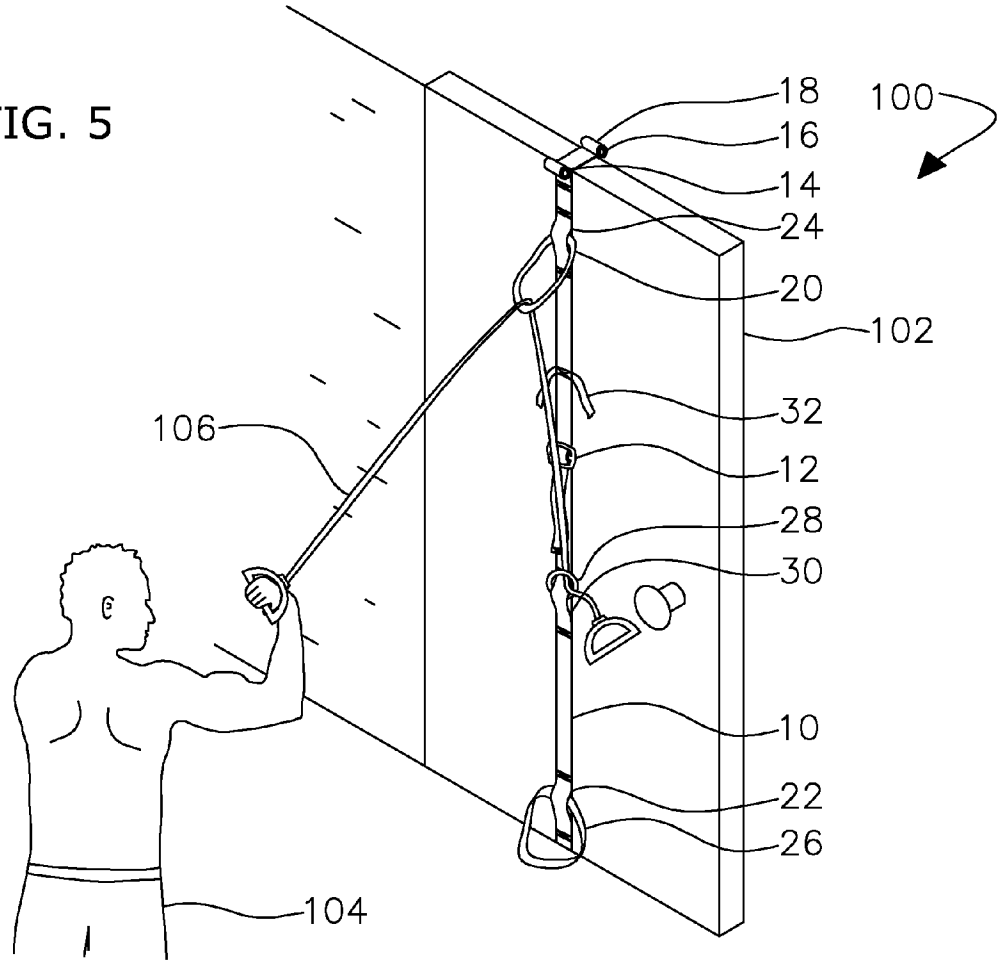
FIG. 5 illustrates a top perspective view of an exercising user using both the second and third non-elastic loops of the apparatus, in accordance with an embodiment of the invention.

In another embodiment of the invention, as shown in FIG. 5, the user 104 has inserted an elastic band 106 through the first non-elastic loop 20 and the third non-elastic loop 28 and is exercising with one arm. Additional non-elastic loops can be added to the adjustable strap 10 on the closing face of the door 102 between the first and second non-elastic loops 20, 22. In this embodiment, a third non-elastic loop 28 is attached to the adjustable strap 10 between the first and second non-elastic loops, 20, 22. The third non-elastic loop 28 shown in FIG. 5 is a metal ring, but can be made of webbing, nylon, woven fabric, plastic, or any other strong material. The third non-elastic loop 28 is attached to the adjustable strap 10 by a third short strip 30. The third short strip 30 can be made of webbing, nylon, woven fabric, or any other strong textile material. The ends of the third short strip 30 are securely attached to the adjustable strap 10 by sewing, glue, epoxy, snaps, or other adhesives or types of fasteners.

Figure 6:
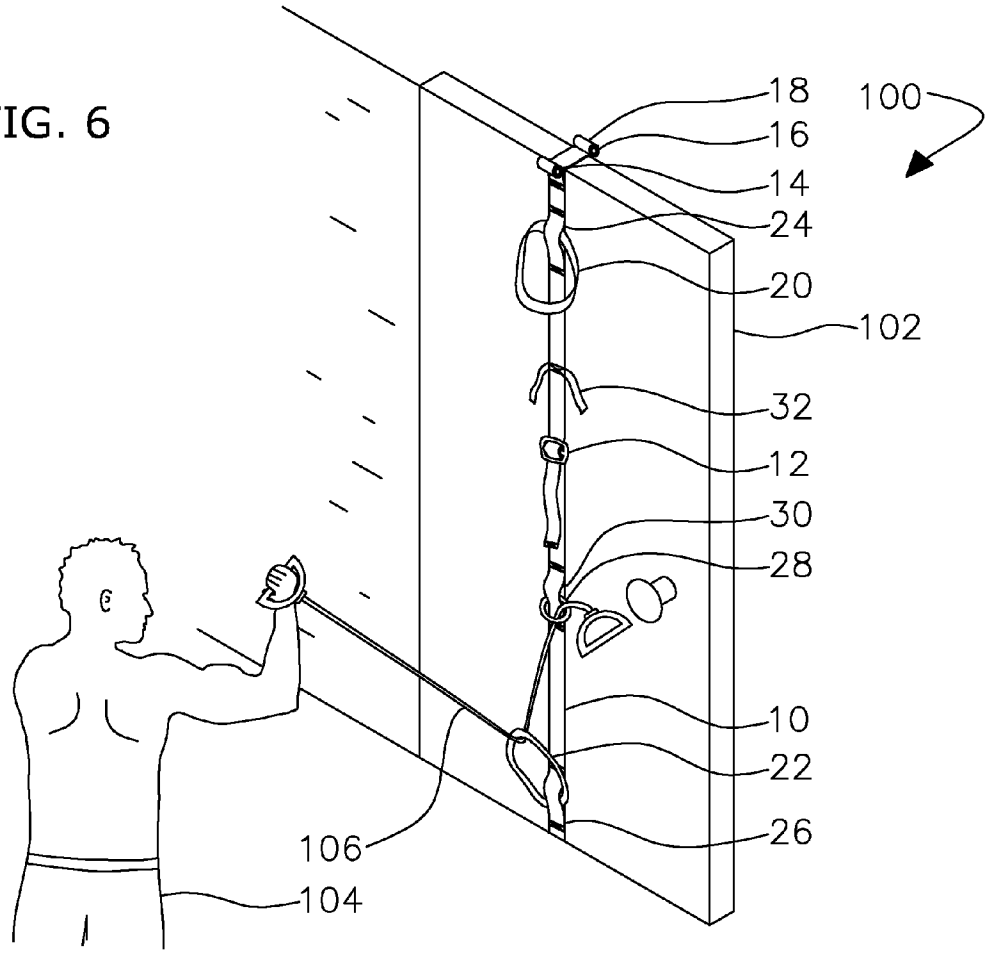
FIG. 6 illustrates a top perspective view of an exercising user using both the first and third non-elastic loops of the apparatus, in accordance with an embodiment of the invention.

In another embodiment of the invention, as shown in FIG. 6, the user 104 has inserted an elastic band 106 through the second non-elastic loop 22 and the third non-elastic loop 28 and is exercising with one arm. By utilizing the first, second, and/or third non-elastic loops 20, 22, 28 either singularly or in tandem, the present invention provides for a wide range of exercise motions, as exercise bands of various tensions may be attached to or passed through one or more of the non-elastic loops 20, 22, 28 and pulled in an unlimited number of directions. This allows any user 104, regardless of their physical strength and capabilities, to exercise a single muscle or many different muscle groups at the same time. By using different body positions and exercise bands of various lengths and tensions, the exercise apparatus 100 will permit isotonic, isometric, concentric, eccentric, plyometric, and P.N.F. patterns of exercises without the risk of personal injury due to slippage.

Figure 8:
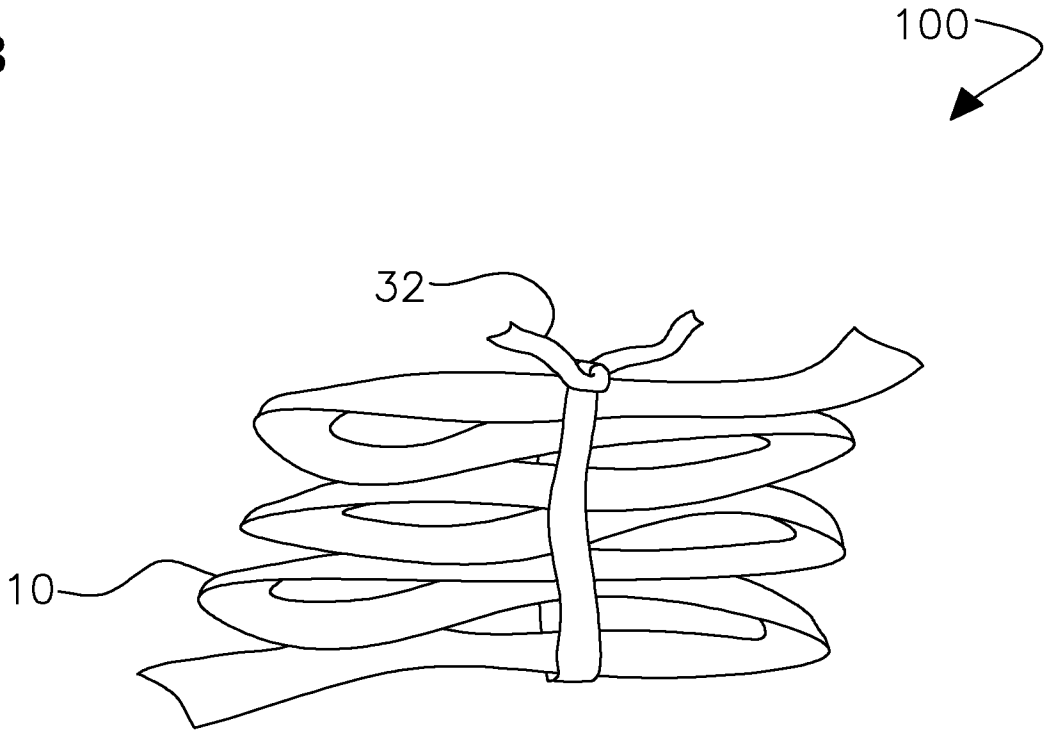
FIG. 8 illustrates an elevation view of the exercise apparatus secured and maintained in a stored configuration by an attached band, in accordance with an embodiment of the invention.

In one embodiment, the exercise apparatus 100 further includes a band 32 attached to the adjustable strap 10 (FIGS. 5-6, 8). As shown in FIG. 8, the exercise apparatus 100 can be conveniently folded or rolled into a compact size. The band 32 wraps around the exercise apparatus 100 to maintain the stored configuration. This permits a user 104 to easily store and/or transport the exercise apparatus 100 to a different location. The band 32 can be made of webbing, nylon, woven fabric, plastic, or any other strong textile material. In FIG. 8, the band 32 has been tied around the exercise apparatus 100. In other configurations, the band may be held in place by snaps, Velcro®, or any other types of fasteners.

Thus, there has been described a door-mounted portable exercise apparatus 100. It is apparent to those skilled in the art, however, that many changes, variations, modifications, other uses, and applications are possible and also such changes, variations, modifications, other uses, and applications which do not depart from the spirit and scope of the invention are deemed covered by the invention, which is limited only by the claims which follow.

What is claimed is:

1. A door-mounted portable exercise apparatus comprising:

a non-elastic adjustable strap extending vertically around a door;

a connector attached to said adjustable strap for maintaining the adjustable strap in a snug position around the door;

a first anchor comprised of an unbreakable compression resistant material that is surrounded by and tightly secured in position by a re-enforcing strap, the re-enforcing strap is secured to said adjustable strap near the top edge of the door and said first anchor is positioned near the junction of the closing face of the door and door frame when the door is in a closed position;

a second anchor comprised of an unbreakable compression resistant material that is surrounded by and tightly secured in position by the re-enforcing strap, the re-enforcing strap is secured to said adjustable strap near the top edge of the door and said second anchor is positioned near the junction of the opening face of the door and door frame when the door is in a closed position;

a first non-elastic loop secured to said adjustable strap by a first short strip near the door and beneath said first anchor;

a second non-elastic loop secured to said adjustable strap by a second short strip near the bottom of the closing face of the door; and the first and second anchors are attached to the adjustable strap 2-6 inches apart.

2. The door-mounted portable exercise apparatus of claim 1, further comprising at least one additional non-elastic loop attached to the adjustable strap by a strip, and said additional non-elastic loop is located between the first and second loops on the closing face of the door.

3. The door-mounted portable exercise apparatus of claim 1, further comprising a band attached to the adjustable strap wherein the band is used to secure and maintain the exercise apparatus in a stored configuration.

4. The door-mounted portable exercise apparatus of claim 1, wherein said connector is located on the closing face of the door.

5. The door-mounted portable exercise apparatus of claim 1, wherein said connector is located on the opening face of the door.

* * * * *